United States Patent [19]

Ikeda

[11] Patent Number: 4,843,688

[45] Date of Patent: Jul. 4, 1989

[54] BUCKLE HAVING BELT ENGAGING FRICTION MEANS

[75] Inventor: Yasuhiko Ikeda, Yokohama, Japan

[73] Assignee: NIFCO, Inc., Yokohama, Japan

[21] Appl. No.: 137,798

[22] Filed: Dec. 24, 1987

[30] Foreign Application Priority Data

Dec. 27, 1986 [JP] Japan ..... 61-200290[U]

[51] Int. Cl.[4] ..... A44B 11/12

[52] U.S. Cl. ..... 24/170; 24/68 E; 24/69 ST; 24/191

[58] Field of Search ..... 24/68 R, 68 SB, 68 E, 24/69 R, 69 ST, 71 R, 71 SB, 170, 173, 191, 193, 197, 69 CT, 69 CF, 179, 168, 184

[56] References Cited

U.S. PATENT DOCUMENTS

| | | | |
|---|---|---|---|
| 804,397 | 11/1905 | Grushus | 24/170 X |
| 2,287,722 | 6/1942 | Beazley | 24/170 |
| 2,513,169 | 6/1950 | Griswold | 24/170 |
| 2,622,293 | 12/1952 | Wermlinger | 24/170 |
| 2,751,656 | 6/1956 | Noe | 24/170 |
| 2,998,626 | 9/1961 | Prete, Jr. | 24/170 |
| 3,328,856 | 7/1967 | Jonas | 24/191 |
| 4,564,983 | 1/1986 | Saito | 24/170 |

FOREIGN PATENT DOCUMENTS

| | | | |
|---|---|---|---|
| 83172 | 10/1895 | Fed. Rep. of Germany | 24/170 |
| 7506705 | 12/1976 | Netherlands | 24/170 |

*Primary Examiner*—Kenneth J. Dorner
*Assistant Examiner*—Laurie K. Cranmer
*Attorney, Agent, or Firm*—Schwartz & Weinrieb

[57] ABSTRACT

A compact buckle, streamlined in appearance, comprises a main body and a stopper piece. The main body includes a pair of side frames, and three shafts disposed between the side frames in such a manner as to extend from one side frame to the other. The stopper piece is axially and pivotably supported between the side frames. The stopper piece is provided with a retaining projection which has a sloped surface for cooperating with a correspondingly sloped surface of a winding shaft, which is one of the aforenoted three shafts, in order to frictionally engage and entrap a belt portion therebetween thereby securing the belt portion within the buckle.

21 Claims, 4 Drawing Sheets

BUCKLE HAVING BELT ENGAGING FRICTION MEANS

FIELD OF THE INVENTION

This invention relates to a buckle provided with means for retaining a belt inserted therethrough, and more particularly to a buckle, in which a stopper piece, having a retaining projection for forcing a belt inserted through the buckle into contact with a winding shaft, is pivotably attached to a main body of the buckle.

BACKGROUND OF THE INVENTION

Heretofore, many kinds of buckles for fastening or retaining a belt, or the like, have been made and used. These conventional buckles have various structures and many functions in accordance with their intended purposes of use.

However, with respect to this general type of buckle, if the structure thereof is such as to assuredly maintain the fastening or retaining state in order to increase the fastening or retaining capability of the belt or the like, it often becomes complicated or bothersome to insert or withdraw the belt or the like into or from the buckle. Moreover, the structure thereof often becomes complicated and bulky. On the other hand, if the buckles are so constructed as to enable easier insertion or withdrawal of the belt or the like therein or therefrom, the retaining state of the buckle is often difficult to maintain and the belt or the like is often unexpectedly withdrawn or loosened.

It is thus difficult to fulfill all of the requisites at the same time, since some of them are incompatible with the others. Unless good balancing of the incompatible factors can be achieved, other improvements in the structure of the buckles is meaningless.

As a typical example of a means for retaining a belt which attempts to fulfill all of the above requisites to the utmost possibility, there is known a buckle such as shown in FIGS. 7 through 9, in which the structure is simplified so as to secure the belt by means of a retaining cam piece of a stopper piece so that the belt can be more easily inserted and released and yet the belt can be tightly fastened by means of the cam piece. More specifically, this conventional buckle comprises a bottom wall 101, side walls 102 provided upon opposite sides of the bottom wall 101, a stopper piece 103 interposed between the side walls 102 and supported at both sides of one end thereof by pivotal supporting means 104, and a cam piece 105 disposed in such a manner as to be generally perpendicular to the stopper piece 103 within the vicinity of the pivotal supporting means 104, whereby a belt inserted between the stopper piece 103 and the bottom wall 101 is frictionally engaged with the bottom wall 101 by means of a top portion 105*a* of the cam piece 105.

This conventional buckle is simple in structure and easy to handle. On the other hand, it has a shortcoming in that since the belt is fastened merely by being biased into contact with the bottom wall 101 by means of tip portion 105*a* of the cam piece 105, even when the belt 106 is pulled back in the $F_1$ direction as seen in FIG. 8, the biasing of frictional pressure of the tip portion 105*a* of the cam piece 105 is not increased. Thus prevention of withdrawal of the inserted belt is not in fact guaranteed.

Furthermore, in this type of conventional buckle, the cam piece 105 has to have sufficient length from the pivotal supporting position of the stopper piece 103 in order to attain a sufficient biasing or frictional pressure for the cam piece tip portion 105*a*. As a result, the buckle is required to have a substantial thickness denoted by d in FIG. 9. Moreover, since the cam piece 105 is required to be pivoted from a horizontal position to a vertical position perpendicular to the bottom wall 101 as shown by the phantom lines of FIG. 9, a large operating space denoted by s is required for the stopper piece 103 as is also shown in FIG. 9.

Furthermore, the buckle is required to be tightly held with one's fingers when the belt 106 is tightly fastened. Therefore, in order to pivotally move the stopper piece 103 immediately after the belt is tightly fastened, the hand holding the belt 106 or the buckle is required to be removed therefrom so that the hand can be engaged in the pivotal movement of the stopper piece 103. Thus, the operation is bothersome. In addition, the belt once fastened is likely to loosen.

As another example of the prior art, there is known another conventional buckle which is shown in FIGS. 10 through 12.

This conventional buckle comprises a main body 202 connected with a belt 201, a stopper member 203 detachably fitted within the main body 202, and a winding rod 204 provided within the buckle main body 202, another belt 205 (or the opposite end of the same belt) wound around the winding rod 204 being urged against one side of the rod 204 by means of the a lower sidewall portion of the stopper member 203.

As a result, when the belt 205 is tightly pulled in the $F_1$ direction and the stopper member 203 is pushed downwardly into the main body 202, the stopper member 203 presses the belt 205 against the winding rod 204 so as to retain it in the tightened state. When the tension of the belt 205 is released in that state, the belt 205 is pulled back in the $F_2$ direction as shown in FIG. 11. As a result, the stopper member 203 tends to be pulled further into the main body 202 as shown by the arrow extending in the $F_3$ direction. As a result, the stronger the reaction of the belt 205 is, the firmer is the retaining state that the stopper 203 creates. This is one of the advantages of this conventional buckle.

Another advantage of this conventional buckle is that the belt 205 can be comparatively easily and smoothly released by raising the stopper member 203 or pulling up the stopper member 203 in the $F_4$ direction.

However, in this conventional buckle, the stopper member 203 must be raised each time the belt 205 is to be released. Moreover, the stopper member 203 must be continuously held in its raised stated until the belt 205 is withdrawn to a predetermined extent. This makes release of the belt bothersome. In addition, the stopper member 203 must be held in its raised state, since otherwise it would fall again due to contact resistance with the belt 205, thus resulting in an unexpected interruption of withdrawal of the belt.

OBJECT OF THE INVENTION

The principal object of the present invention is to provide a buckle, in which a belt can be firmly retained and easily released.

SUMMARY OF THE INVENTION

To this end, a buckle according to the present invention comprises a main body including a pair of side frames, a belt mounting shaft connecting one side frame to the other at one end portion, a belt winding shaft likewise connecting one side frame to the other at a position spaced apart from the belt mounting shaft, and a stopper piece pivotably supported at both sides and at one end thereof upon the side frames at the ends thereof having the mounting shaft mounted thereon, the stopper piece being provided with a retaining projection projecting downwardly from an under-surface portion thereof such that when the stopper piece is pushed pivotably moved into the main body, the projection is brought to a position immediately adjacent to, but slightly space from, the belt winding shaft such that when the belt is wrapped or wound about the belt winding shaft, the belt will be interposed and trapped between the belt winding shaft and the stopper piece projection.

With the above-mentioned construction of the buckle, one belt is attached to the mounting shaft and the other belt is wound around the belt winding shaft and reversed in direction. Thereafter, the stopper piece is pushed into the main body. Then, the reversely turned surface of the belt is forced into contact with the winding shaft by means of the retaining projection projecting downwardly from the under-surface of the stopper piece and firmly held at such position.

BRIEF DESCRIPTION OF THE DRAWINGS

The above and other objects and features of the invention will become more apparent from the following detailed description with reference to the accompanying drawings, wherein.

DETAILED DESCRIPTION OF THE ILLUSTRATED EMBODIMENTS

Figure 1:
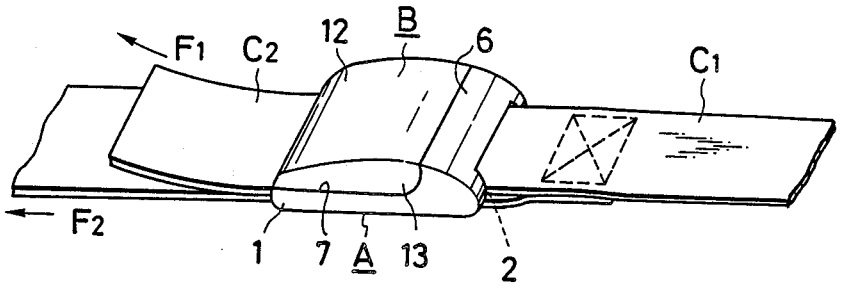
FIG. 1 is a perspective view showing a buckle according to one embodiment of the present invention.
Figure 2:
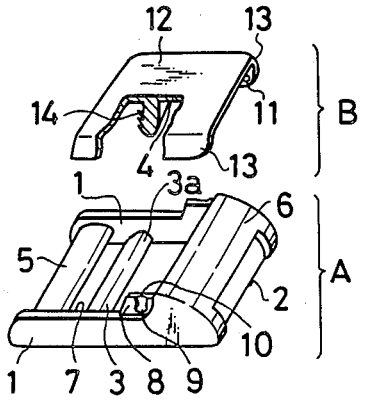
FIG. 2 is an exploded perspective view of the buckle of FIG. 1.
Figure 3:
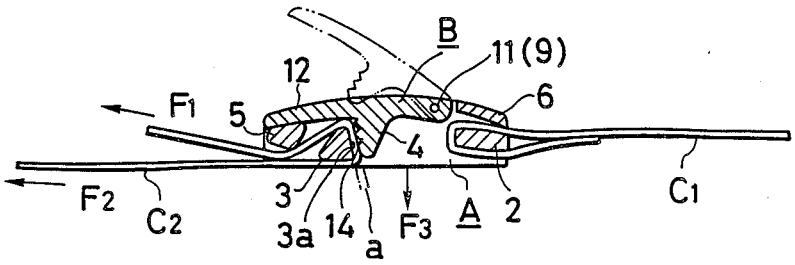
FIG. 3 is a sectional view of the buckle of FIG. 1.

FIGS. 1 through 3 illustrate a buckle according to one embodiment of the present invention. The buckle comprises a buckle main body A and a stopper piece B. The buckle has inserted therein or wound thereon two belts $C_1$ and $C_2$. In this buckle, the main body and the stopper piece may be made of a metal material, or of a plastic material formed by injection molding.

The buckle main body A comprises a pair of side frames 1, and three shafts 2, 3 and 5 bridging one side frame to the other for mounting, winding and guiding a belt, or the like. The mounting shaft 2 and winding shaft 3 are formed integrally with the opposing side portions of the side frames 1 and at one end and a substantially central portion of the main body A, whereas the guide shaft 5 is disposed at an opposite end of the main body A and is also formed integrally with the side frames 1. The winding shaft 3 has a sloped surface 3*a* gradually extending downwards and sideways and serving as a surface for cooperating with a retaining projection 4 of the stopper piece B in order to frictionally engage opposite surfaces of the belt $C_2$ when the belt $C_2$ is to be retained within the buckle.

Furthermore, a reinforcing cover portion 6 is provided between the side frames 1 in such a fashion as to cover the upper surface of the mounting shaft 2, so as to reinforce the strength of the buckle main body A and also to provide the buckle main body A with a simple outer appearance. An upper portion of each side frame 1 excluding the reinforcing cover portion 6 forms a cut-away portion 7. The stopper piece B is mounted within the cut-away portion 7. The cut-away portion 7 is formed with a rising portion 8 at the forward side of the reinforcing cover portion 6. The rising portion 8 is provided upon the outer side surface thereof with a bearing hole 9, and the bearing hole 9 is formed with a tapered guide groove 10 for allowing a pivotal supporting portion of the stopper piece B to be pivotably disposed therein.

The mounting shaft 2 for the belt $C_1$ is formed so as to have a flat shape in section so that the belt $C_1$ can be easily attached. The winding shaft 3 is provided with a surface for cooperating with the retaining projection 4 of the stopper piece B in order to frictionally retain a portion of the belt $C_2$ therebetween. This contacting surface is formed so as to have a substantially vertical surface. The bottom surface of the winding shaft 3 is flat. Thus, the winding shaft 3 has a generally triangular shape in section. By providing an acute angle at the top thereof, the winding shaft 3 can prevent the belt $C_2$ from loosening in the $F_2$ direction. The winding shaft 3 and the mounting shaft 2 are disposed such that the axes thereof are generally aligned upon a common horizontal line so that loads of the belts $C_1$ and $C_2$ can be disposed along a common plane.

The guide shaft 5 is formed so as to have a generally inverted triangular shape in section, so that the belt $C_2$ positioned over the upper surface of the winding shaft 3 will pass downwardly along the slanted rear surface thereof. If necessary, more than one guide shaft 5 may be provided.

The stopper piece B is formed so as to have a configuration which is that of a generally rectangular plate. The stopper piece B is provided upon the inner lateral surfaces at one end thereof with respective projecting shafts 11. In addition, the stopper B is integrally provided upon its undersurface with a retaining projection 4. The general configuration of the stopper piece B is such that it can be suitably mounted within the cut-away portions 7 of the side frames 1 of the buckle main body A.

More specifically, the stopper piece B is provided at each side of a plate shaped portion 12 with a dependent side plate portion 13 so that when the stopper piece B covers the cut-away portion 7 of the buckle main body A, it cooperates with the buckle main body A so as to form a substantially flattened and rectangular shaped body as a whole. The stopper piece B is provided upon the inner sides of the side plate portions 13 with the aforementioned projecting shafts 11. The plate shaped portion 12 is provided upon its under-surface with the aforementioned retaining projection 4. The surface of the retaining projection 4 facing the winding shaft 3 is preferably a non-slip surface 14 having a plurality of projections thereon. Moreover, the non-slip surface 14 is preferably made thick and is slanted with respect to the base portion side of the retaining projection 4. A space a formed between the non-slip surface 14 at the projection 4 and the vertical wall surface 3*a* of the winding shaft 3 when the stopper piece B is pushed pivotably moved into the buckle main body A, is small enough so that when the belt $C_2$ is inserted therewithin it is contacted under pressure by means of both surfaces. In this case, when the retaining projection 4 has an inclined surface such as 14, there can be obtained a firmer retaining force.

Figure 4:
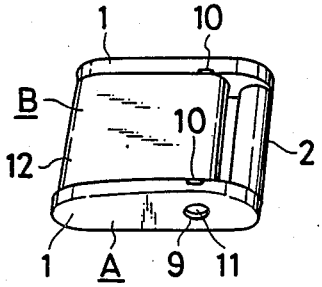
FIG. 4 is a perspective view showing a buckle according to another embodiment of the present invention.
Figure 5:
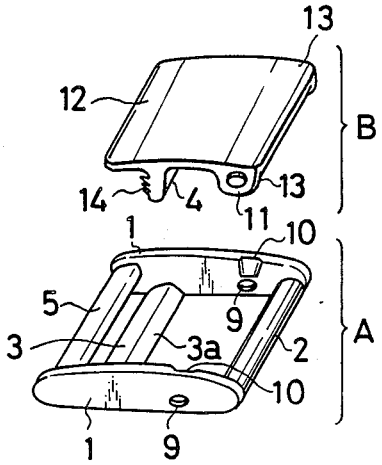
FIG. 5 is an exploded perspective view of the buckle of FIG. 4.

Next, a second embodiment of the present invention will be described with reference to FIGS. 4 and 5. In this second embodiment, the stopper piece B is pivotally supported such that it is accommodated laterally within the frames 1 of the buckle main body A. Specifically, each side frame 1 is provided with an aperture 9 for pivotally supporting the stopper piece B at a position to the left of the mounting shaft 2 as viewed in the figures, and the apertures 9 are provided with tapered grooves 10 for guiding projecting shafts 11 of the stopper piece B to into apertures 9. Moreover, the side plate portions 13 of the stopper piece B are provided upon the outside surfaces thereof with the projecting shafts 11. Due to the foregoing arrangement, the stopper piece B can be both laterally and longitudinally accommodated within the buckle main body A. Thus, the buckle can be made more compact.

Figure 6:
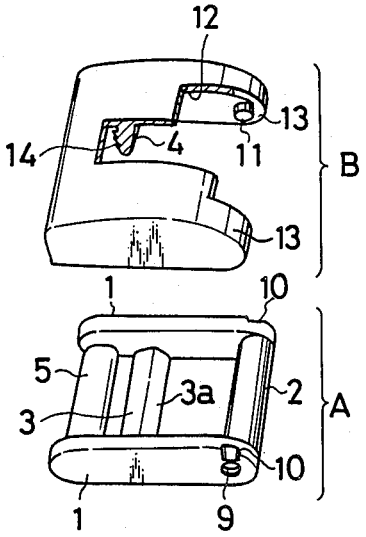
FIG. 6 is an exploded perspective view, partly cutaway, showing a buckle according to still another embodiment of the present invention.
Figure 7:
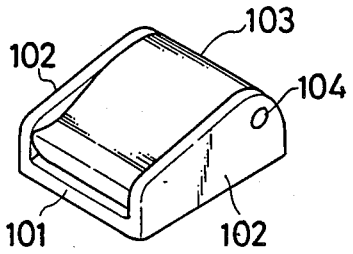
FIG. 7 PRIOR ART
FIG. 7 is a perspective view of a conventional buckle.
Figure 8:
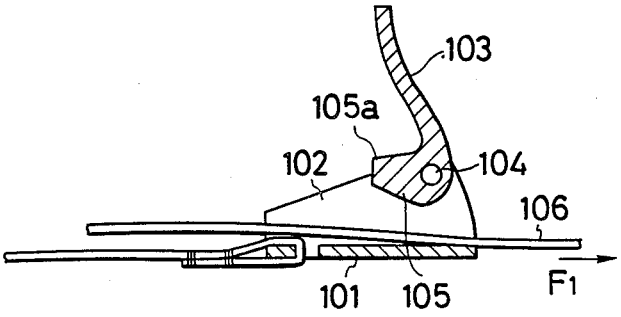
FIG. 8 PRIOR ART
FIG. 8 is a sectional view of the buckle of FIG. 7, with a belt inserted therethrough.
Figure 9:
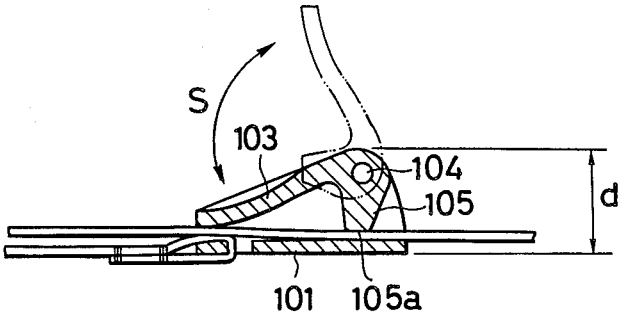
FIG. 9 PRIOR ART
FIG. 9 is a sectional view of the buckle of FIG. 7 retaining a belt therein.
Figure 10:
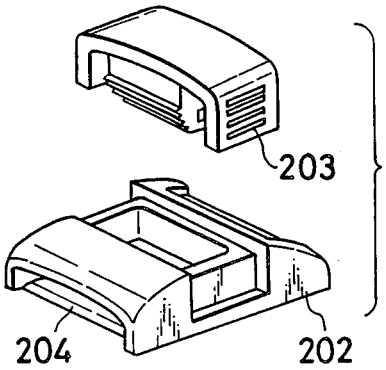
FIG. 10 PRIOR ART
FIG. 10 is an exploded perspective view of a conventional buckle.
Figure 11:
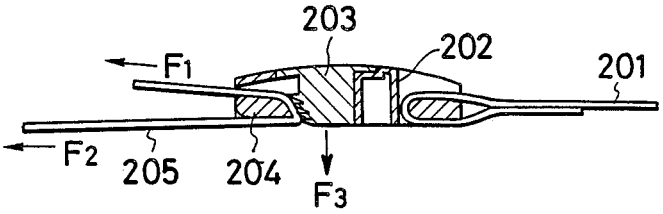
FIG. 11 PRIOR ART
FIG. 11 is a sectional view of the buckle of FIG. 10 retaining a belt therein.
Figure 12:
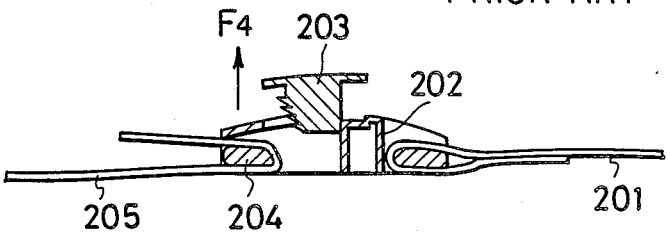
FIG. 12 PRIOR ART
FIG. 12 is a sectional view of the buckle of FIG. 10, with the belt released.

FIG. 6 illustrates a third embodiment of the present invention, in which the buckle main body A is completely covered by means of the stopper piece B. Specifically, the side plate portions 13 of the stopper piece B completely cover the buckle main body side frames 1. The projecting shafts 11 of the stopper piece B are inserted into and pivotally supported within apertures 9 formed within the outer surface of the side frames 1 of the buckle main body A. As a result, when in use, the buckle main body A is completely covered by means of the stopper piece B. Thus, the buckle can be more simplified.

With the above-mentioned construction, the belt $C_1$ is attached to the mounting shaft 2, whereas the other belt $C_2$ is wound around the winding shaft 3 and turned back upon itself. The stopper piece B is pushed into contact with the reversely turned surface of the belt $C_2$ and the reversely turned surface of the belt $C_2$ is contacted under pressure and retained upon the winding shaft 3 by means of the side surface 14 of the retaining projection 4.

As described in the foregoing, the tightening operation of the belt $C_2$ can be simply performed by pulling the belt $C_2$ in the $F_1$ direction. At that time, since the buckle, or the like, is not required to be held by one's finger, the buckle can be tightened by means of a one-hand operation and is thus advantageous. Particularly, the locking of the tightening belt $C_2$ by means of the stopper piece B can be performed using the free hand. Therefore, the belt can be prevented from loosening during locking.

Furthermore, when the belt $C_2$ is tightened to a predetermined extend so as to be ready to be locked, it is sufficient for the stopper piece B to be simply pushed into the buckle main body A so that the retaining projection 4 thereof can frictionally engage the belt $C_2$ wound around the winding shaft 3. By releasing the force applied to the belt $C_2$ in the $F_1$ direction when the belt $C_2$ is disposed in its locked state, in other words, by interrupting the tightening of the belt $C_2$, the belt $C_2$ produces a reaction force in the $F_2$ direction. The reaction force acts such that the retaining projection 4 is pulled downwardly further into the main body A in the $F_3$ direction as shown for example, in FIG. 3. As a result, the stronger the tightening force of the belt $C_2$, the more firmly the belt $C_2$ is locked by means of the stopper piece B.

Since both the belts $C_1$ and $C_2$ are wound upon the buckle main body A and the loads thereof are directed to the buckle main body A, the stopper piece B is almost totally unaffected by means of external forces acting upon the belt $C_2$. Therefore, the stopper piece B can be easily raised or pivotably moved into the buckle main body A without fail. In addition, the retaining projection 4 of the stopper piece B pressed downwardly so as to contact the belt $C_2$ is pulled downwardly still further, without fail, by means of reaction force directed in the $F_2$ direction relative to the belt $C_2$, thereby ensuring the firmly locked state.

More particularly, since the non-slip surface 14 of the retaining projection 4 is sloped and the surface 3*a* of the winding shaft 3 is correspondingly sloped, the space a defined between the surfaces 14 and 3*a* is made narrower as the retaining projection 4 is pushed vertically downwardly. Therefore, the belt $C_2$ wound around the winding shaft 3 is more firmly retained within the buckle.

The buckle can be released simply by raising the stopper piece B. The stopper piece B can be raised by holding it with one's fingers and also by pulling the belt $C_2$ slightly further in the $F_1$ direction. Thus, an easy operation can be obtained. Moreover, since it is not necessary to hold the stopper piece B after it has been raised, the belt can be smoothly and rapidly released by means of one hand.

Furthermore, since the stopper piece B need only be operated to the extent that the retaining projection 4 is lifted from the vicinity of the winding shaft 3 by means of the vertical movement of the stopper piece B, the opening or closing extent thereof is small compared with the conventional buckle. Moreover, since the belt $C_2$ is reversed in direction as a result of being wrapped about the surface of the winding shaft 3 and the reversely turned portion of the belt $C_2$ is pressed into contact with the surface 3*a* of the winding shaft 3 by means of the side surface 14*a* of the retaining projection 4, the buckle can be rendered relatively thin in its thickness dimension.

Still further, since the buckle main body A is covered by means of the stopper piece B, the buckle exhibits a simple outer appearance. In addition, the plate shaped portion of the stopper piece B can be printed with letters, or other indicia.

Obviously, many modifications and variations of the present invention are possible in light of the above teachings. It is therefore to be understood that within the scope of the appended claims, the present invention may be practiced otherwise than as specifically described herein.

What is claimed is:

1. A buckle, comprising:

a main body including a pair of side frames wherein each of said side frames includes a cut-out portion within a forward region thereof, and a cover portion interconnecting rear regions of said side frames together;

a belt mounting shaft, interconnecting one side frame to the other side frame at said rear region of said side frames and disposed beneath said cover portion so as to be covered thereby, for mounting one end of a belt;

a belt winding shaft interconnecting one side frame to the other side frame at a position spaced apart from said belt mounting shaft and disposed within said forward region of said side frames, and having a first surface for engaging a portion of a second end of said belt to be wound thereon; and a stopper piece pivotably supported at one end thereof upon said side frames between a first open position and a second closed position, and including an upper surface which forms a continuous contoured surface with said cover portion of said main body when said stopper piece is disposed at said second closed position, dependent side walls integral with said upper surface for disposition within said cut-out portions of said main body side frames so as to form continuous surface portions therewith when said stopper piece is disposed at said second closed position, and a retaining projection projecting downwardly from an undersurface portion of said upper surface such that when said stopper piece is disposed at said second closed position, said projection is brought to a position adjacent to said belt winding shaft so as to dispose a second belt engaging surface into cooperation with said first belt engaging surface of said belt winding shaft and thereby retain said second end of said belt therebetween.

2. The buckle as claimed in claim 1, wherein said retaining projection is provided on a surface thereof facing with said belt winding shaft a plurality of projections.

3. A buckle as set forth in claim 1, wherein:

said second belt engaging surface of said stopper piece is disposed in a substantially vertical plane; and said first belt engaging surface of said belt winding shaft is disposed in a substantially vertical plane.

4. A buckle as set forth in claim 3, wherein:

said stopper projection and said belt winding shaft have substantially triangular configurations, one side of said triangular configurations comprising said first and second engagement surfaces.

5. A buckle as set forth in claim 1, wherein:

said belt winding shaft and said belt mounting shaft are integral with said side frames of said main body.

6. A buckle as set forth in claim 1, wherein:

said belt winding shaft and said belt mounting shaft are disposed in a substantially common horizontal plane.

7. A buckle as set forth in claim 1, wherein:

said first belt engaging surface of said belt winding shaft and said second belt engaging surface of said stopper piece are disposed at predetermined inclined angles with respect to a horizontal plane.

8. A buckle, comprising:

a main body including a pair of side frames wherein each of said side frames has a predetermined length defined between a rear end thereof and a forward end thereof, and an upper surface thereof which has a substantially arcuate configuration;

a belt mounting shaft, interconnecting one side frame to the other side frame at said rear ends of said side frames such that a rear end portion of said belt mounting shaft and said rear ends of said side frames form a substantially continuous contoured surface extending in a transverse direction between said side frames, for mounting one end of a belt;

a belt winding shaft, interconnecting one side frame to the other side frame at a position spaced apart from said belt mounting shaft as considered in a longitudinal direction extending parallel to said side frames and disposed within a forward region of said side frames, and having a first surface for engaging a portion of a second end of said belt to be wound thereon; and a stopper piece pivotably mounted at one end thereof, upon said side frames at a position longitudinally spaced from said belt mounting shaft, between a first open position and a second closed position, and having a width dimension which is slightly less than the length defined between interior sidewall portions of said side frames so as to be disposed between said side frames, an upper surface having a substantially arcuate configuration which matches said substantially arcuate configuration of said upper surfaces of said side frames so as to define therewith a substantially continuous contoured upper surface when said stopper piece is disposed at said second closed position, a length dimension such that an opposite, forward end thereof forms a substantially continuous contoured surface, extending in said transverse direction, along with said forward ends of said side frames of said main body when said stopper piece is disposed in said second, closed position, and a retaining projection projecting downwardly from an undersurface portion of said upper surface of said stopper piece such that when said stopper piece is disposed at said second closed position, said projection is brought to a position adjacent to said belt winding shaft so as to dispose a second belt engaging surface into cooperation with said first belt engaging surface of said belt winding shaft and thereby retain said second end of said belt therebetween.

9. A buckle as set forth in claim 8, further comprising:

teeth projections disposed upon said second belt engaging surface of said stopper piece for frictionally grasping and securing said second end of said belt when said stopper piece is disposed at said second closed position.

10. A buckle as set forth in claim 8, wherein:

said first belt engaging surface of said belt winding shaft is disposed in a substantially vertical plane; and said second belt engaging surface of said stopper piece is disposed in a substantially vertical plane.

11. A buckle as set forth in claim 10, wherein:

said belt winding shaft and said stopper projection have substantially triangular cross-sectional configurations, one side of said triangular configurations comprising said first and second belt engaging surfaces.

12. A buckle as set forth in claim 8, wherein:

said belt winding shaft and said belt mounting shaft are integral with said side frames of said main body.

13. A buckle as set forth in claim 8, wherein:

said belt winding shaft and said belt mounting shaft are disposed in a substantially common horizontal plane.

14. A buckle as set forth in claim 8, wherein:

said first belt engaging surface of said belt winding shaft and said second belt engaging surface of said stopper piece are disposed at predetermined inclined angles with respect to a horizontal plane.

15. A buckle, comprising:

a main body including a pair of transversely spaced, longitudinally extending side frames;

a belt mounting shaft, interconnecting said transversely spaced, longitudinally extending side frames at a rear region of each of said side frames, for mounting one end of a belt;

a belt winding shaft interconnecting said transversely spaced, longitudinally extending side frames at a position longitudinally spaced from said belt mounting shaft, and having a first surface for engaging a portion of a second end of said belt to be wound thereon; and a stopper piece pivotably mounted at one end thereof, upon said side frames between a first open position and a second closed position, and including an upper surface which forms a continuous contoured external surface for said buckle when said stopper piece is disposed at said second closed position, dependent side walls integral with said upper surface of said stopper piece for enveloping said side frames of said main body when said stopper piece is disposed at said second, closed position, and a retaining projection projecting downwardly from an undersurface portion of said upper surface of said stopper piece such that when said stopper piece is disposed at said second closed position, said projection is disposed at a position adjacent to said belt winding shaft so as to dispose a second belt engaging surface into cooperation with said first belt engaging surface of said belt winding shaft and thereby retain said second end of said belt therebetween.

16. A buckle as set forth in claim 15, wherein:

said second belt engaging surface of said stopper piece includes teeth projections for frictionally grasping and engagingly securing said second end of said belt when said stopper piece is disposed at said second closed position.

17. A buckle as set forth in claim 15, wherein:

said first belt engaging surface of said belt winding shaft is disposed in a substantially vertical plane; and said second belt engaging surface of said stopper piece is disposed in a substantially vertical plane.

18. A bucklet as set forth in claim 17, wherein:

said belt winding shaft and said stopper projection have substantially triangular cross-sectional configurations, one side of said triangular configurations comprising said first and second belt engaging surfaces.

19. A buckle as set forth in claim 15, wherein:

said belt winding shaft and said belt mounting shaft are integral with said side frames of said main body.

20. A buckle as set forth in claim 15, wherein:

said belt winding shaft and said belt mounting shaft are disposed in a substantially common horizontal plane.

21. A buckle as set forth in claim 15, wherein:

said first belt engaging surface of said belt winding shaft and said second belt engaging surface of said stopper piece are disposed at predetermined inclined angles with respect to a horizontal plane.

* * * * *